US007013762B2

(12) United States Patent
Hsien

(10) Patent No.: US 7,013,762 B2
(45) Date of Patent: Mar. 21, 2006

(54) HANDLE TOOL

(76) Inventor: Chin-Ching Hsien, 235 Chung-Ho Box 8-24, Taipei (TW)

( * ) Notice: Subject to any disclaimer, the term of this patent is extended or adjusted under 35 U.S.C. 154(b) by 64 days.

(21) Appl. No.: 10/800,795

(22) Filed: Mar. 16, 2004

(65) Prior Publication Data

US 2005/0204871 A1 Sep. 22, 2005

(51) Int. Cl.
*B25B 13/46* (2006.01)

(52) U.S. Cl. ..... 81/124.3; 81/124; 81/124.7; 81/125; 81/63.2

(58) Field of Classification Search ..... 81/124, 81/124.3, 124.7, 125
See application file for complete search history.

(56) References Cited

U.S. PATENT DOCUMENTS 5,626,062 A * 5/1997 Colvin ..... 81/63.2
6,006,630 A * 12/1999 Vasichek et al. ..... 81/125
6,530,299 B1 * 3/2003 Liu ..... 81/451

* cited by examiner

*Primary Examiner*—Lee D. Wilson
*Assistant Examiner*—Anthony Ojini

(57) ABSTRACT

A handle tool comprises a spanner body; at least one opening being formed at one end of the spanner body; an inner wall of the flower form opening being formed with a resisting portion; the resisting portion being formed with a plurality of ratchet teeth for buckling an elastic restoring unit; a smooth portion at an lower edge of the resisting portion; a diameter of the smooth portion being slightly larger than that of the resisting portion. Thereby, when a hexagonal screwing unit of the screw unit buckled against the resisting annual element will be received in the smooth portion of the flower form opening. Since no ratchet tooth is formed on the smooth portion and the diameter of the smooth portion is slightly larger than that of the hexagonal screwing unit of the screw unit, the spanner body will rotate idly.

6 Claims, 11 Drawing Sheets

HANDLE TOOL

FIELD OF THE INVENTION

The present invention relates to handle tools, and particular to a flower form spanner which can restore from a reverse rotate and can be made easily with a lower cost.

BACKGSEMI-ROUND OF THE INVENTION

In the prior art flower form spanner, a head portion of the spanner has an opening for receiving a hexagonal screwing unit of a screw unit. Then a moving force is applied to the spanner so that the screw unit can be locked or detached.

Generally, in the operation of a flower form spanner, the spanner must be moved reciprocally. In locking or detaching a screw unit, a periphery of the screw unit often has obstacles. The flower form spanner must be taken out from the screw unit. Then the opening of the spanner is aligned to and engaged with the hexagonal screwing unit for screwing the screw unit again. However, this operation must be performed repeatedly so that the operation is tedious.

Thereby, in this prior art, the user must reversely operate the spanner so that the working time is prolonged.

Moreover, the spanner must be aligned to a connecting unit of a hexagonal screwing unit so that the operation is inconvenient, especially in a narrow space. If the space is too narrow, it is possible that the operation cannot be performed.

To improve above mentioned defects, ratchet spanners are developed, but the ratchet spanners are too expansive to be used widely.

SUMMARY OF THE INVENTION

Accordingly, the primary object of the present invention is to provide a handle tool which comprises the following elements.

A spanner body has one end formed with a flower form opening. An inner wall of the flower form opening is formed with a resisting portion. The resisting portion is formed with a plurality of ratchet teeth. The resisting portion serves for screwing and buckling a screwing means. A shoulder portion is formed at an upper edge of the resisting portion.

A smooth portion is being at a lower edge of the resisting portion. A diameter of the smooth portion is slightly larger than that of the resisting portion. That is to say, it is slightly larger than a screwing element. Thereby, when the screwing element is screwed in the smooth portion, the spanner body can rotate reversely for retracting out.

A restoring unit has a C ring, a connecting unit, an elastomer, and a resisting annual element. The connecting unit is made of plastic element. Thereby, the connecting unit is bendable and deformable. An upper and a lower end of the connecting unit have an upper ring and a lower ring, respectively. The upper ring has an annular recessed buckle. The recessed buckle can be buckled in a shoulder of the flower form opening by using the C ring. The lower ring is able to buckle the resisting annual element. An annular slot is installed between the upper ring and the lower ring for receiving the elastomer. An inner diameter of the elastomer is slightly larger than that of the annular slot and slightly smaller than those of the upper ring and the lower ring. By above mentioned restoring unit, if no force is applied, an hexagonal screwing unit of a screwing element can be pushed into the smooth portion.

Thereby, the hexagonal screwing unit of the screw unit buckled against the resisting annual element will be received in the smooth portion of the flower form opening. Since in the present invention, no ratchet tooth is formed on the smooth portion and the diameter of the smooth portion is slightly larger than that of the hexagonal screwing unit of the screw unit, the spanner body will rotate idly. Thus it has an effect of reverse rotation and restoration. When the spanner body rotates reversely, a pressing force is applied so that the hexagonal screwing unit of the screw unit will further buckle the resisting portion at the inner wall of the flower form opening. Thereby, the screw unit can be moved further. Thus, by using the smooth portion, the flower form opening can be moved reciprocally rapidly. However, the long moving time in the prior art flower form spanner is improved by above mentioned design. Thus, the spanner of the present invention can be used in a narrow space.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
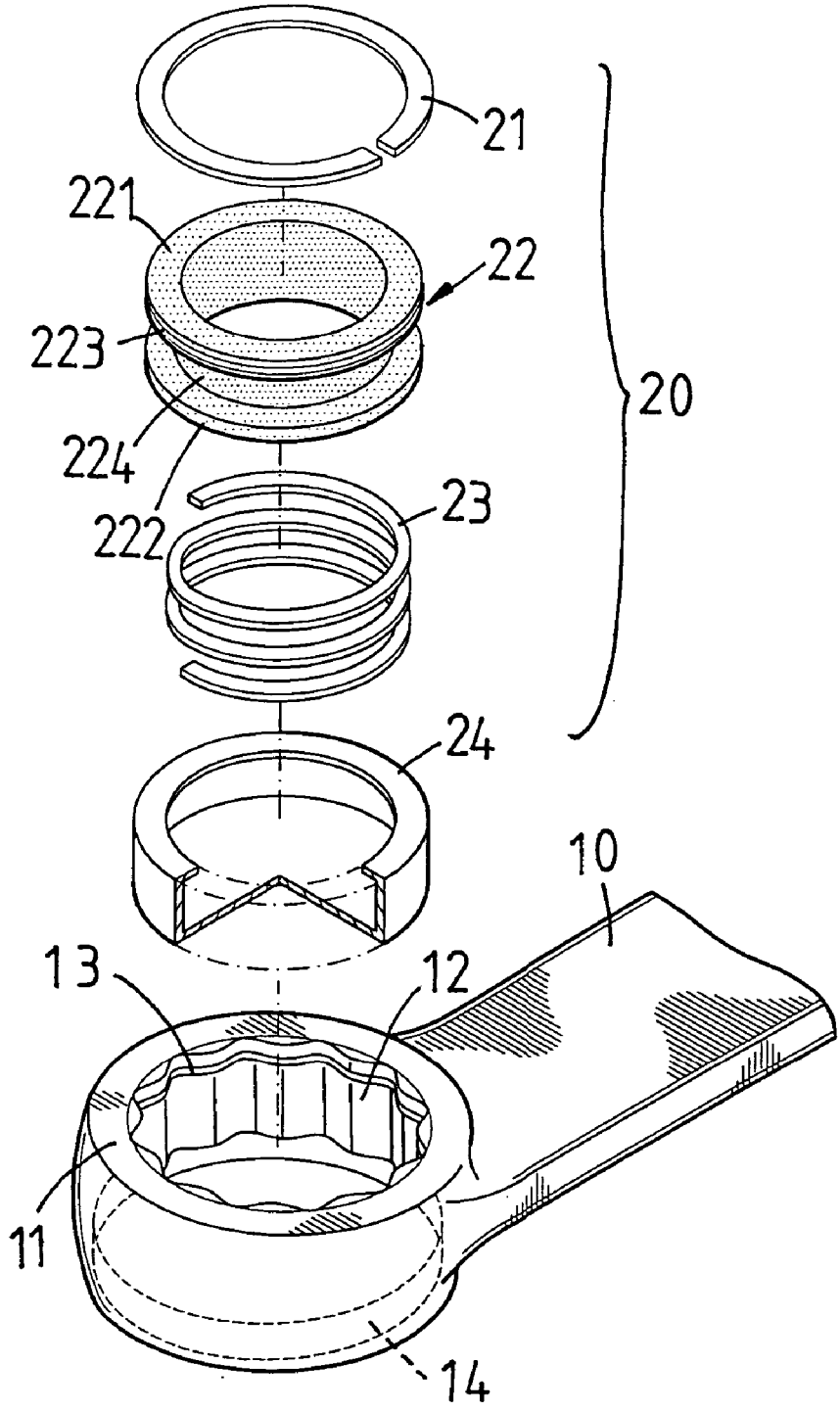
FIG. 1 is an exploded view of the handle tool in the first embodiment of the present invention.
Figure 2:
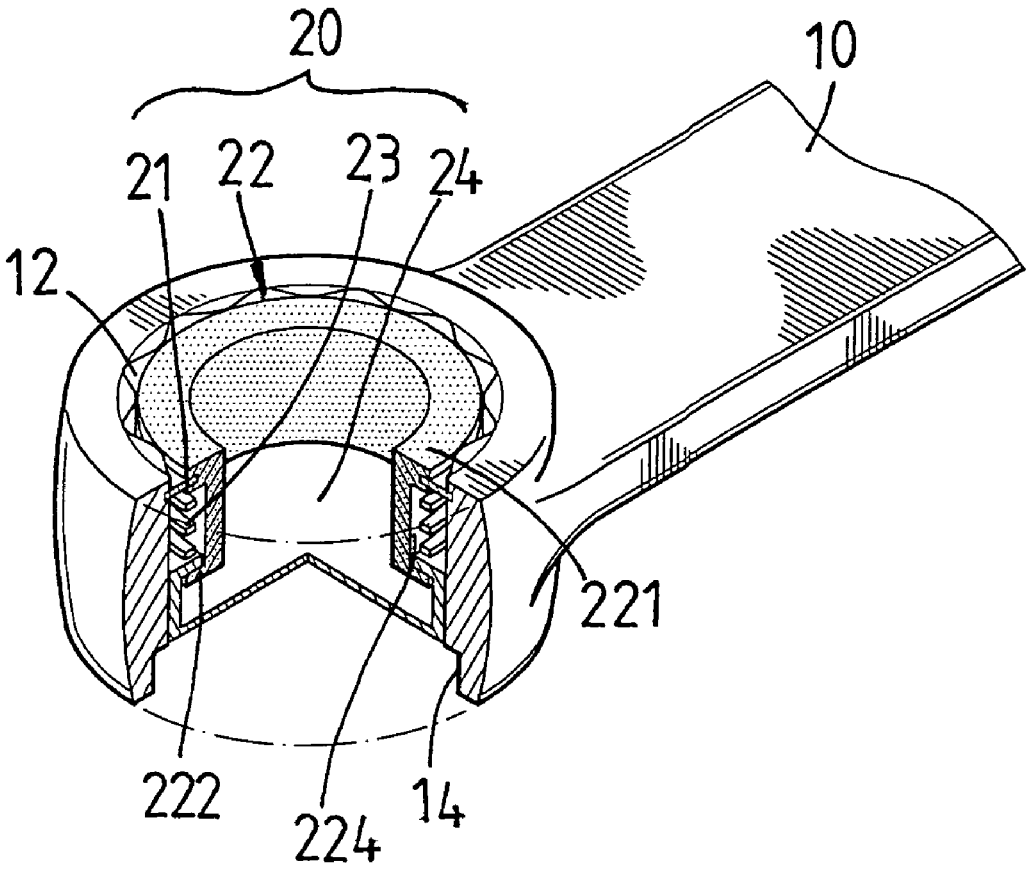
FIG. 2 is a perspective view of the handle tool in the first embodiment of the present invention.
Figure 3:
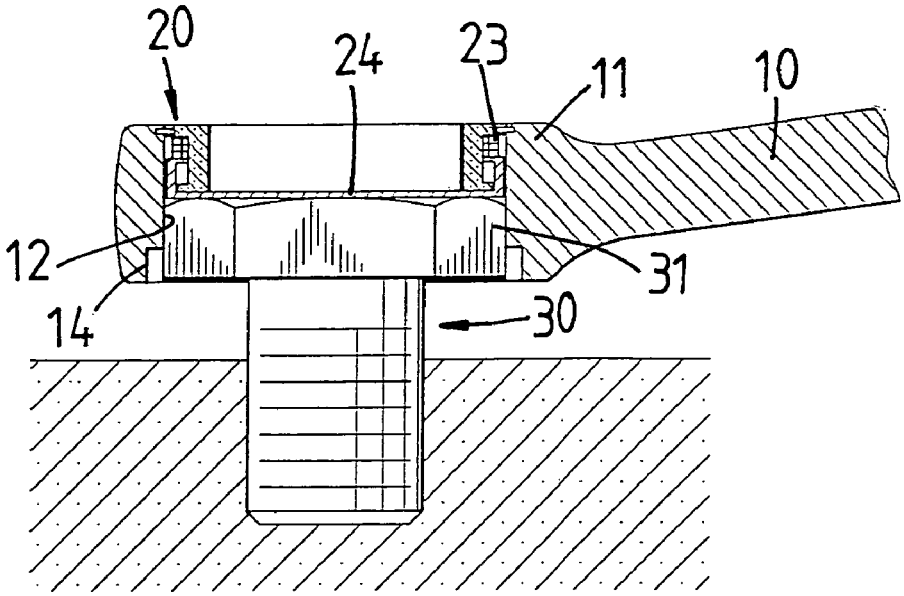
FIG. 3 is a cross section view of the handle tool in the first embodiment of the present invention.
Figure 4:
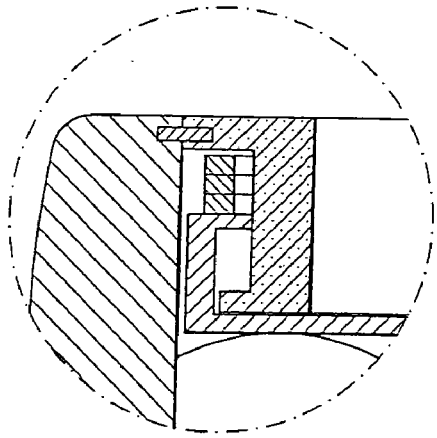
FIG. 4 is a partial cross section view of the handle tool in FIG. 3.
Figure 5:
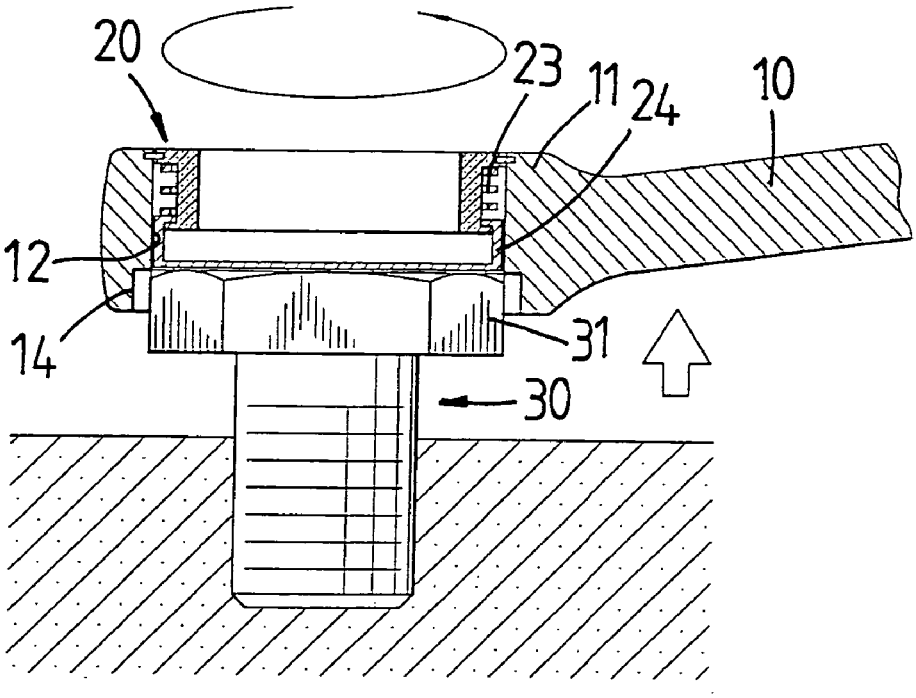
FIG. 5 is a cross section view of the handle tool of the present invention.
Figure 6:
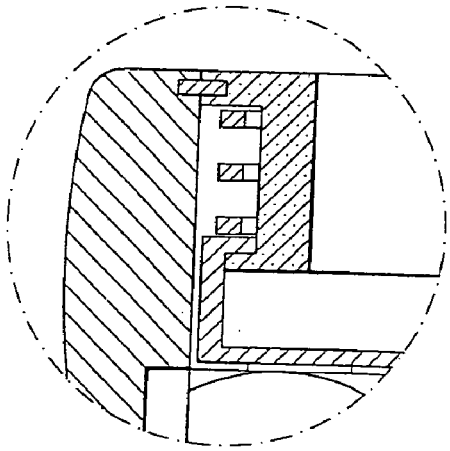
FIG. 6 is a partial cross section view of the handle tool in FIG. 5.

With reference to FIGS. 1 and 2, the structure of the present invention is illustrated. The present invention includes the following elements.

A spanner body 10 has at one end which is formed with a flower form opening 11. An inner wall of the flower form opening 11 is formed with a resisting portion 12. The resisting portion 12 is formed with a plurality of ratchet teeth. The resisting portion 12 serves for screwing and buckling a screwing means. A shoulder portion 13 is formed at an upper edge of the resisting portion 12.

A smooth portion 14 is formed at a lower edge of the resisting portion 12. A diameter of the smooth portion 14 is slightly larger than that of the resisting portion 12. That is to say, it is slightly larger than a screwing element. Thereby, when the screwing element is screwed in the smooth portion 14, the spanner body 10 can rotate reversely for retracting out.

A restoring unit 20 has a C ring 21, a connecting unit 22, an elastomer 23, and a resisting annual element 24. The connecting unit 22 is made of plastic element. Thereby, the connecting unit 22 is bendable and deformable. An upper and a lower end of the connecting unit 22 have an upper ring 221 and a lower ring 222, respectively. The upper ring 221 has an annular recessed buckle 223. The recessed buckle 223 can be buckled in a shoulder 13 of the flower form opening 11 by using the C ring 21. The lower ring 222 is able to buckle the resisting annual element 24. An annular slot 224 is installed between the upper ring 221 and the lower ring 222 for receiving the elastomer 23. An inner diameter of the elastomer 23 is slightly larger than that of the annular slot 224 and slightly smaller than those of the upper ring 221 and the lower ring 222. By above mentioned restoring unit 20, if no force is applied, a hexagonal screwing unit of a screwing element can be pushed into the smooth portion 14.

In assembling of the present invention, since the connecting unit 22 is made of plastic material, the elastomer 23 is engaged into the annular space 224 of the connecting unit 22 so that the elastomer 23 is confined in the annular slot 224. Then the resisting annual element 24 is buckled into the lower ring 222 of the connecting unit 22 so that the resisting annual element 24 is pushed by the elastomer 23. Then the C ring 21 is buckled to the recessed buckle 223 of the connecting unit 22 and the shoulder 13 of the flower form opening 11 so that the restoring unit 20 is assembled to the flower form opening 11.

In use of the present invention, with reference to FIGS. 3 to 6, when locking or detaching a screw unit 30, the flower form opening 11 of the spanner body 10 serves to lock the screw unit 30. Then a downward pressing force is applied. The force is larger than the resisting force of the elastomer 23 in the restoring unit 20. Thereby, the elastomer 23 is inwards reduced. Meanwhile, the hexagonal screwing unit 31 at an upper end of the screw unit 30 is buckled to the resisting portion 12 in the inner wall of the flower form opening 11. When the spanner body 10 is moved to resist against an obstacle so that the spanner body 10 cannot be rotated, the user can release. The elastomer 23 in the restoring unit 20 will restore to generate a restoring elastic force so that the spanner body 10 moves upwards. Thereby, the hexagonal screwing unit 31 of the screw unit 30 buckled against the resisting annual element 24 will be received in the smooth portion 14 of the flower form opening 11. Since in the present invention, no ratchet tooth is formed on the smooth portion 14 and the diameter of the smooth portion 14 is slightly larger than that of the hexagonal screwing unit 31 of the screw unit 30, the spanner body 10 will rotate idly. Thus it has an effect of reverse rotation and restoration. When the spanner body 10 rotates reversely, a pressing force is applied so that the hexagonal screwing unit 31 of the screw unit 30 will further buckle the resisting portion 12 at the inner wall of the flower form opening 11. Thereby, the screw unit 30 can be moved further. Thus, by using the smooth portion 14, the flower form opening 11 can be moved reciprocally rapidly. However, longer moving time in the prior art flower form spanner is improved by above mentioned design. Thus, the spanner of the present invention can be used in a narrow space.

Figure 7:
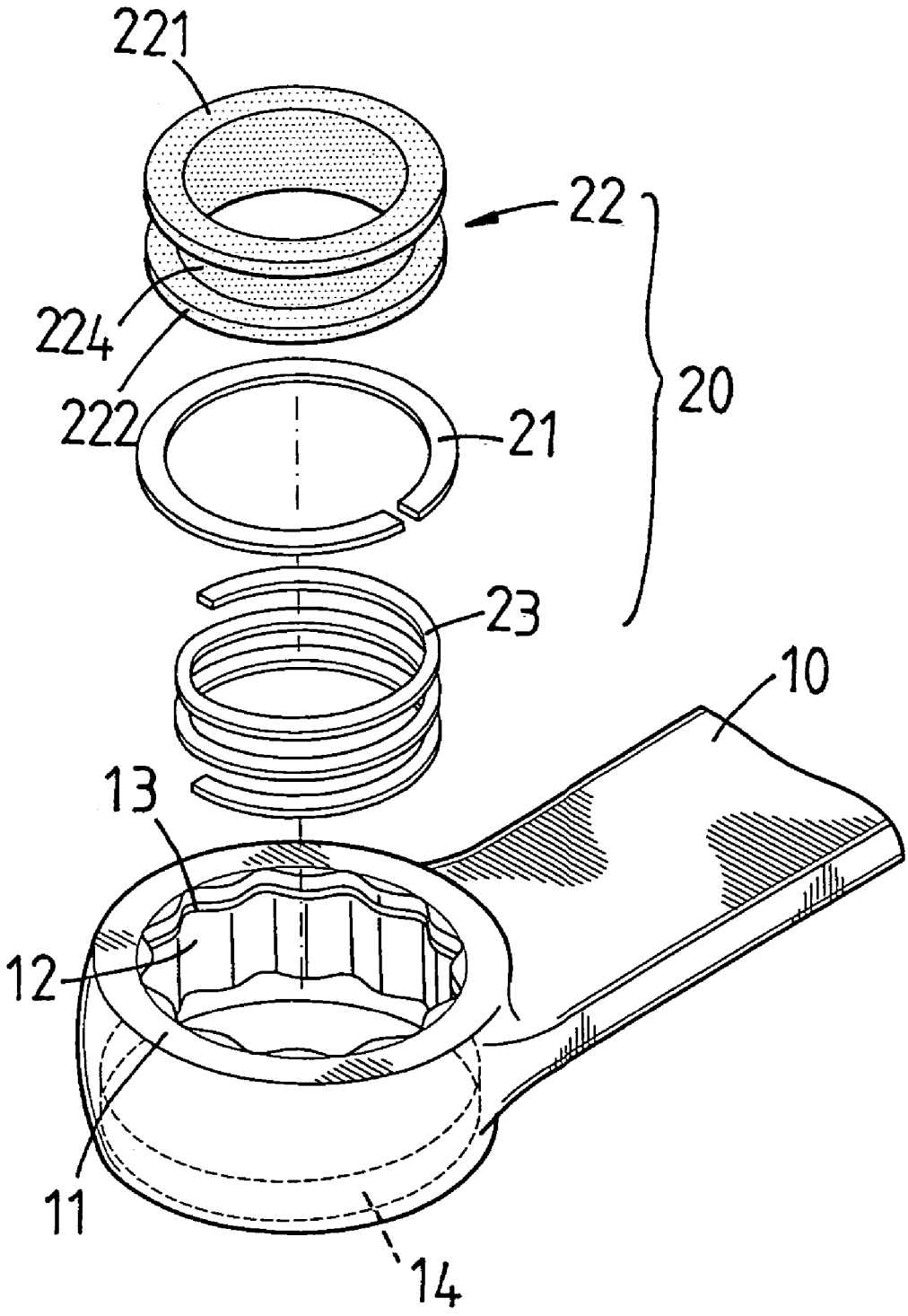
FIG. 7 is an exploded view of the handle tool in the second embodiment of the present invention.
Figure 8:
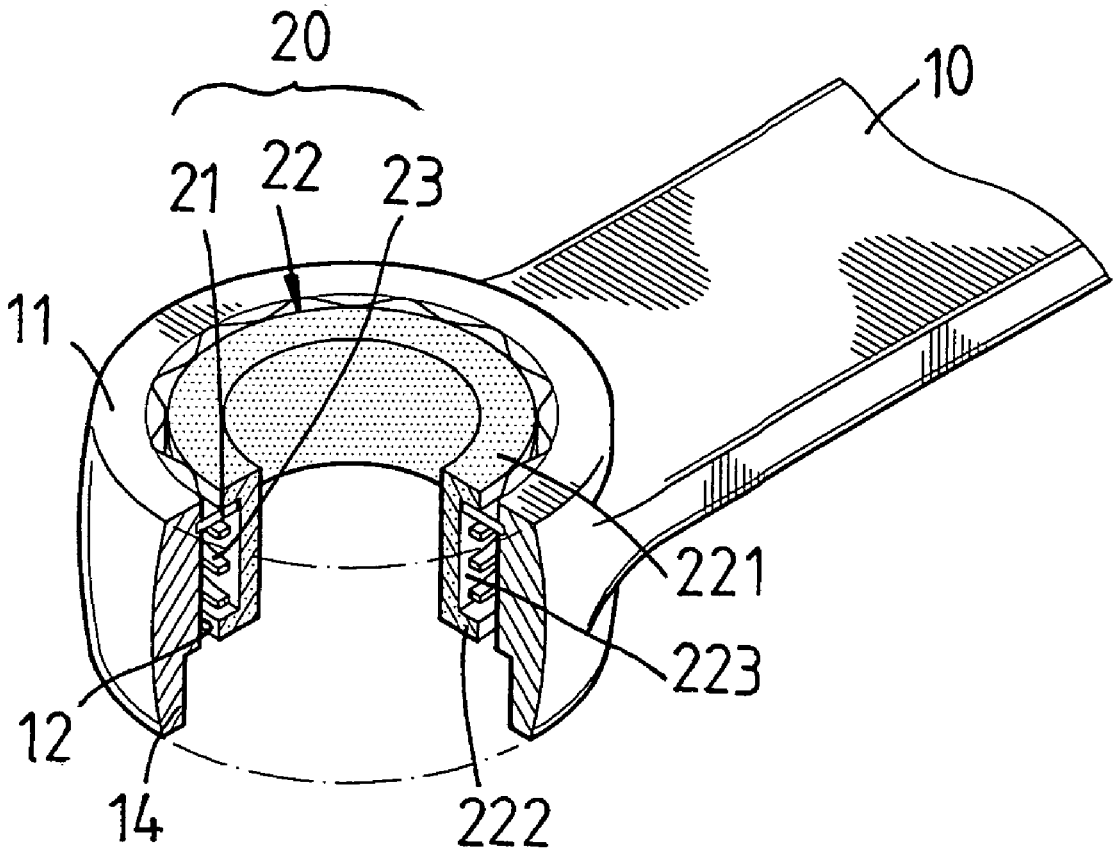
FIG. 8 is a perspective view of the handle tool in the second embodiment of the present invention.
Figure 9:
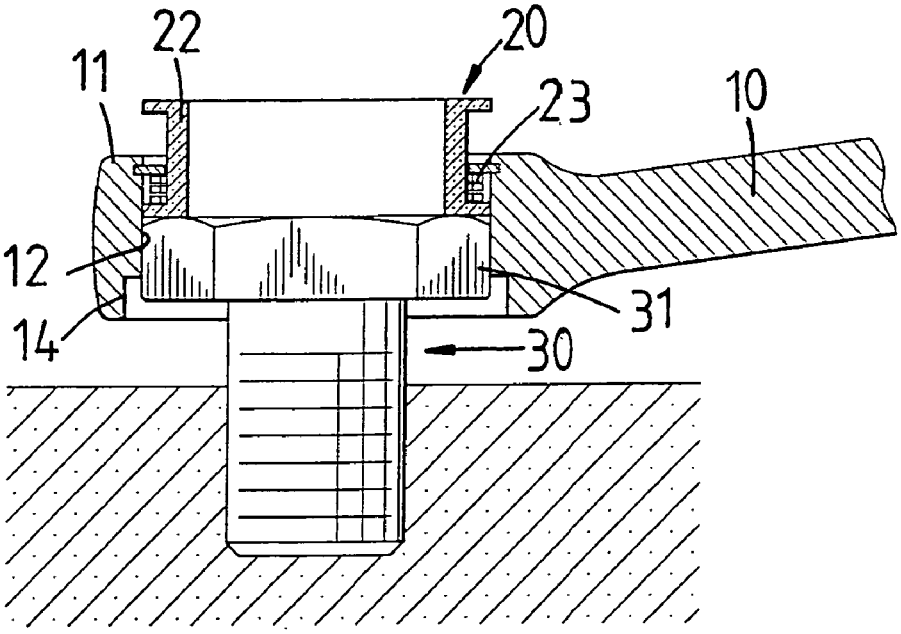
FIG. 9 is a cross section view showing the use of the handle tool in the second embodiment of the present invention.
Figure 10:
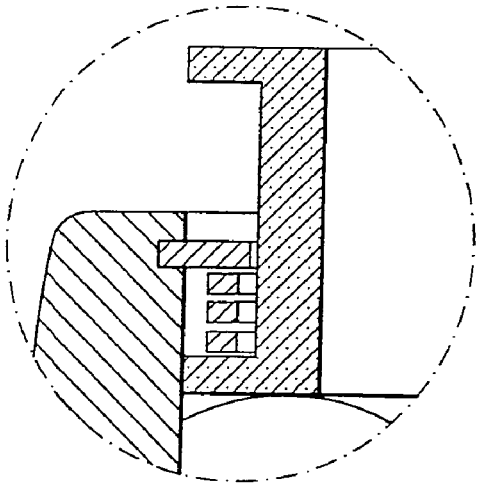
FIG. 10 is a partial cross section view of the handle tool in FIG. 9.
Figure 11:
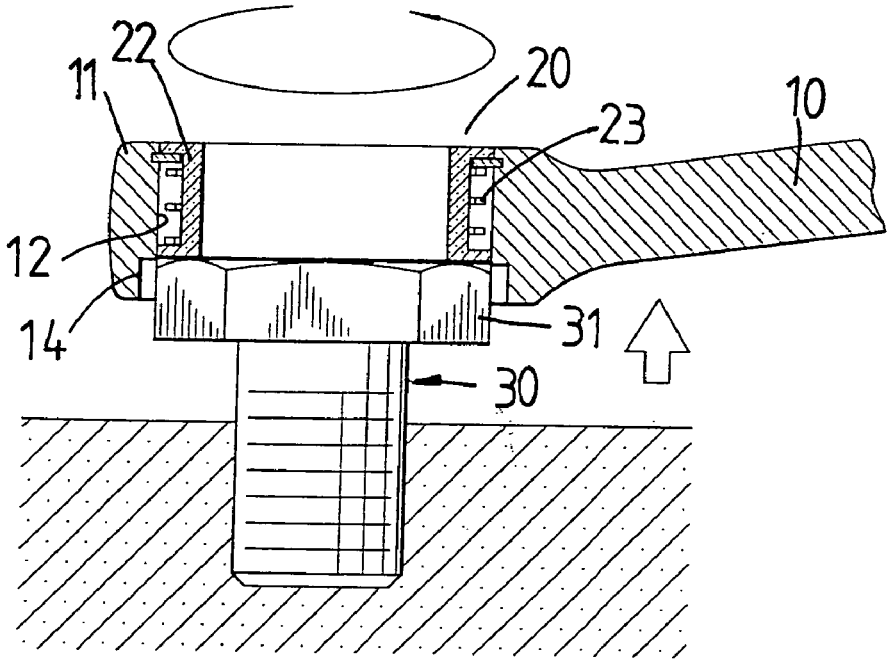
FIG. 11 is a cross section view showing the application of the handle tool in the second embodiment of the present invention.
Figure 12:
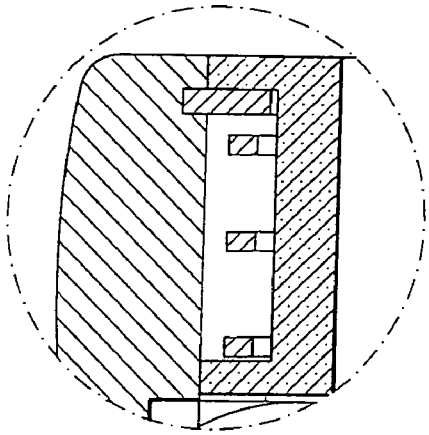
FIG. 12 is a partial cross section view of the second embodiment in FIG. 11.
Figure 13:
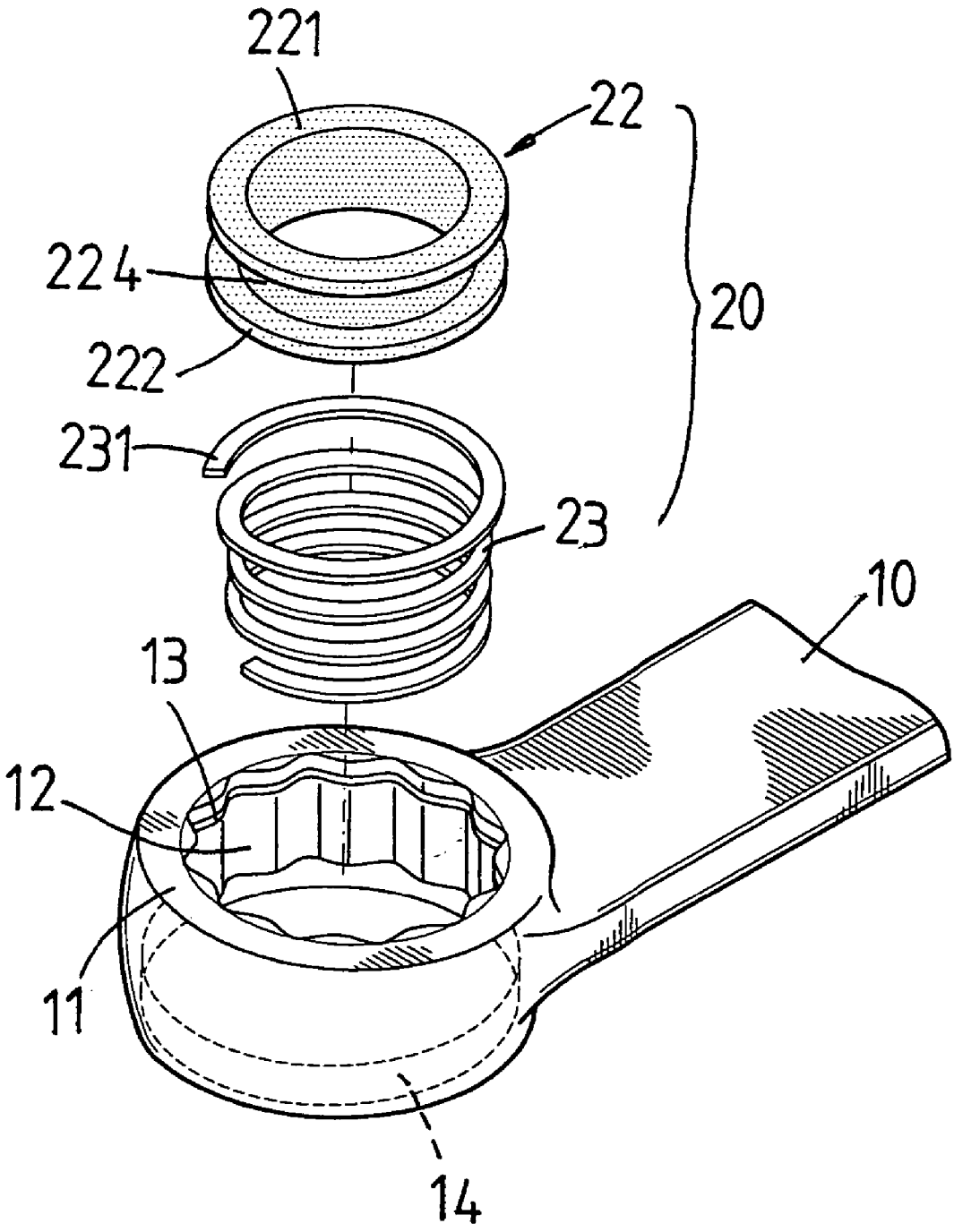
FIG. 13 is an exploded view of the third embodiment of the present invention.
Figure 14:
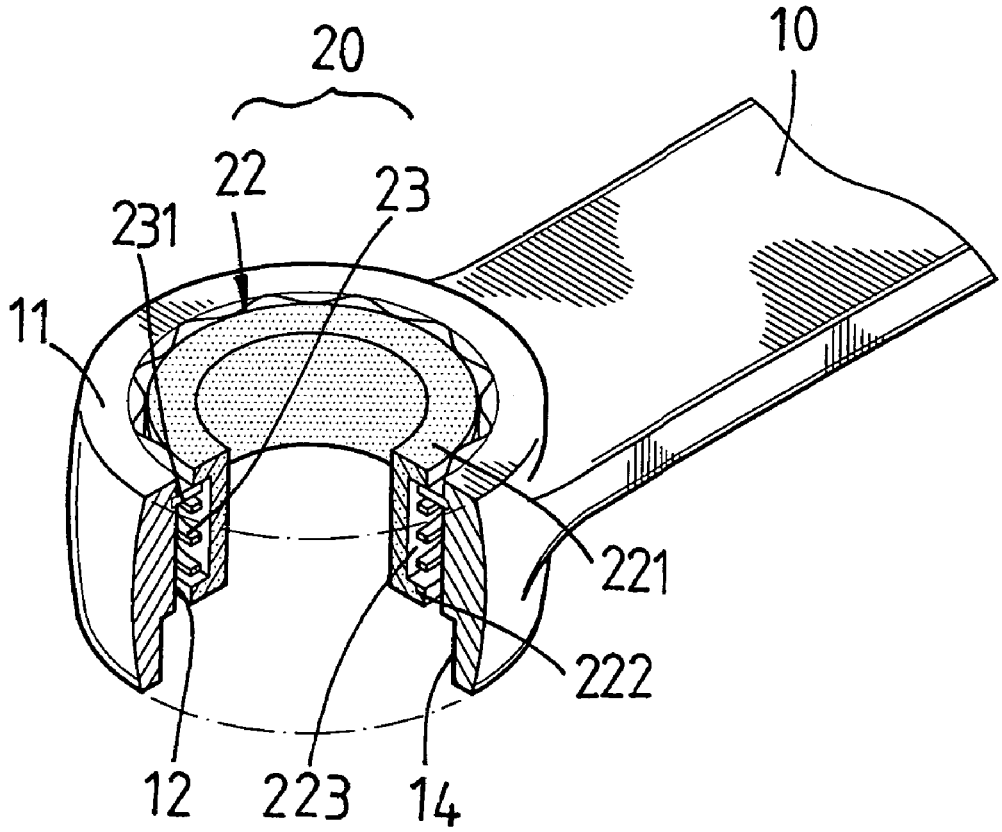
FIG. 14 is a perspective view of the handle tool in the third embodiment of the present invention.
Figure 15:
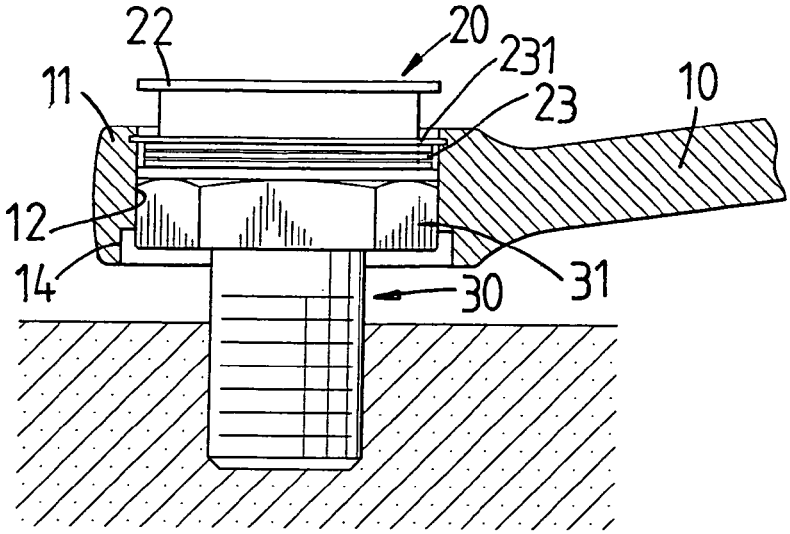
FIG. 15 is a cross section view showing the application of the handle tool in the third embodiment of the present invention.
Figure 16:
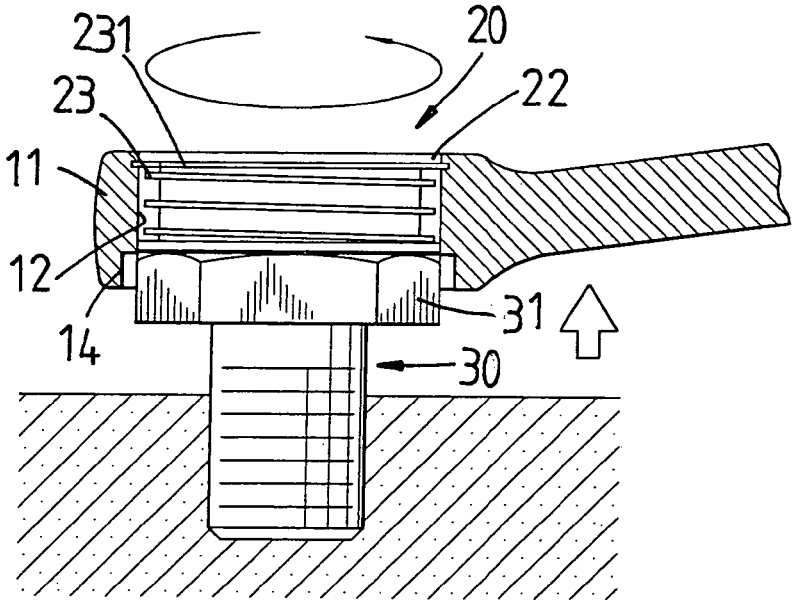
FIG. 16 is a cross section view showing the application of handle tool in the third embodiment of the present invention.

Referring to FIGS. 7 and 8, a second embodiment of the present invention is illustrated. Most of the elements of the two embodiments are identical and thus the details of these elements will not be described herein. To use the handle of the present invention easily, the restoring unit 20 can be replaced by a C ring 21, a connecting unit 22 and an elastomer 23. The connecting unit 22 is made of plastic material and thus the connecting unit 22 is bendable and deformable. An upper and a lower end of the connecting unit 22 have an upper ring 221 and a lower ring 222, respectively. An annular slot 224 is formed between the upper ring 221 and the lower ring 222 for receiving the elastomer 23. The annular slot 224 serves to receive the C ring 21 and the elastomer 23. An inner diameter of the C ring 21 is slightly larger than that of the annular slot 224 and smaller than that of the upper ring 221. An inner diameter of the elastomer 23 is slightly larger than that of the annular slot 224 and slightly smaller than those of the upper ring 221 and the lower ring 222.

In assembling the present invention, since the connecting unit 22 is made of plastic material, the elastomer 23 can be engaged into the annular slot 224 of the connecting unit 22 so that the elastomer 23 is confined in the annular slot 224 of the connecting unit 22 and the shoulder 13 of the flower form opening 11. After completing the assembling work, since an upper end of the elastomer 23 is confined by the C ring 21, the elastomer 23 will push the lower ring 22 to contact the lower end of the elastomer 23. Since an inner diameter of the C ring 21 is slightly larger than annular slot 224 of the connecting unit 22, the connecting unit 22 confined by the C ring 21 can move longitudinally in a small extent.

In use of the present invention, referring to FIGS. 9 to 12, when locking or detaching a screw unit 30, the flower form opening 11 of the spanner body 10 serves to engage the screw unit 30, and then a downward pressing force is applied. Since the force is larger than the resisting force in the elastomer 23 of the restoring unit 20, the elastomer 23 will upwards reduce so that the connecting unit 22 originally pushed downward by the elastomer 23 will protrude upwards out of the flower form opening 11. Meanwhile, the hexagonal screwing unit 31 at an upper end of the screw unit 30 resists against the resisting portion 12 on the inner wall of the flower form opening 11. When the spanner body 10 rotates to resist against the obstacle and thus the spanner body 10 cannot be rotated further, the user releases, by the restoring elastic force of the elastomer 23 in the restoring unit 20, the spanner body 10 will move upwards. As a result, the hexagonal screwing unit 31 of the screw unit 30 resisting against the connecting unit 22 will be received in the smooth portion 14. Thus, the screw unit 30 restores.

With reference to FIGS. 13 to 16, a third embodiment of the present invention will be described. The main elements of this embodiment are identical to that of the second embodiment and thus the detail will not further described. In this embodiment, a buckle 231 is installed at an upper end of the elastomer 23. The elastomer 23 serves to combine the connecting unit 22 with the flower form opening 11.

An inner diameter of the elastomer 23 is slightly larger than that of the annular slot 224 and slightly smaller than those of the upper ring 221 and the lower ring 222. By above mentioned restoring unit 20, if no force is applied, an hexagonal screwing unit of a screwing element can be pushed into the smooth portion 14.

In assembling of the present invention, since the connecting unit 22 is made of plastic material, the elastomer 23 is engaged into the annular space 224 of the connecting unit 22 so that the elastomer 23 is confined in the annular slot 224. Then the resisting annual element 24 is buckled into the lower ring 222 of the connecting unit 22 so that the resisting annual element 24 is pushed by the elastomer 23. Then the C ring 21 is buckled to the recessed buckle 223 of the connecting unit 22 and the shoulder 13 of the flower form opening 11 so that the restoring unit 20 is assembled to the flower form opening 11.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A handle tool comprising:

a spanner body; at least one opening being formed at one end of the spanner body; an inner wall of the opening being formed with a resisting portion; the resisting portion being formed with a plurality of ratchet teeth;

an elastic restoring unit buckled by the plurality of ratchet teeth;

a smooth portion at a lower edge of the resisting portion; a diameter of the smooth portion being slightly larger than that of the resisting portion; wherein when the elastic restoring unit does not applied a force to a screw unit, the screw unit is within the smooth portion.

2. The handle tool as claimed in claim 1, wherein the elastic restoring unit is formed by a C ring, a connecting unit, a resisting element, and an elastomer.

3. The handle tool as claimed in claim 2, wherein the connecting unit is buckled by the C ring so as to be fixed to the opening.

4. The handle tool as claimed in claim 1, wherein the elastic restoring unit is formed by a C ring, a connecting unit, and an elastomer.

5. The handle tool as claimed in claim 4, wherein when a downward force is applied to the screw unit from the opening, the connecting unit of the elastic restoring unit protrudes out of the opening.

6. The handle tool as claimed in claim 1, wherein the elastic restoring unit is formed by a connecting unit and an elastomer.

* * * * *